US005417919A

United States Patent [19]

Ohori et al.

[11] Patent Number: 5,417,919

[45] Date of Patent: May 23, 1995

[54] ALUMINUM ALLOY MATERIAL HAVING HIGH STRENGTH AND EXCELLENT FORMABILITY

[75] Inventors: Koichi Ohori, Mishima; Yoshinobu Komiyama, Shizuoka; Hiroshi Saitoh, Susono; Masahiko Miyazaki, Susono, all of Japan

[73] Assignee: Mitsubishi Aluminum Co., Ltd., Tokyo, Japan

[21] Appl. No.: 110,162

[22] Filed: Aug. 20, 1993

[51] Int. Cl.[6] ..... C22C 21/08

[52] U.S. Cl. ..... 420/532; 148/439; 148/440; 420/535; 420/541; 420/544; 420/553

[58] Field of Search ..... 420/535, 553, 544, 532, 420/541; 148/439, 440

[56] References Cited

U.S. PATENT DOCUMENTS 2,564,044 8/1951 Willmore ..... 420/535
4,043,840 8/1977 Sperry et al. ..... 420/535

FOREIGN PATENT DOCUMENTS 62-44549 2/1987 Japan .
3-111532 5/1991 Japan .

*Primary Examiner*—Melvyn J. Andrews
*Assistant Examiner*—Robert R. Koehler
*Attorney, Agent, or Firm*—Frishauf, Holtz, Goodman & Woodward

[57] ABSTRACT

There is provided an aluminum alloy sheet material having high strength as well as excellent formability, which consists essentially, by weight percent, of 4.5 to 6% Mg, 0.0005 to 1% rare earth elements, 0.001 to 0.15% Ti, 0.0001 to 0.004% B, 0.05 to 0.2% Fe, 0.05 to 0.1% Si, 0.0001 to 0.03% Be, and the balance of Al and inevitable impurities. The aluminum alloy sheet material may further contain at least one element selected from the group consisting of 0.05 to 0.3% Cu, 0.1 to 1% Zn and 0.05 to 0.2% Mn, if required.

6 Claims, 1 Drawing Sheet

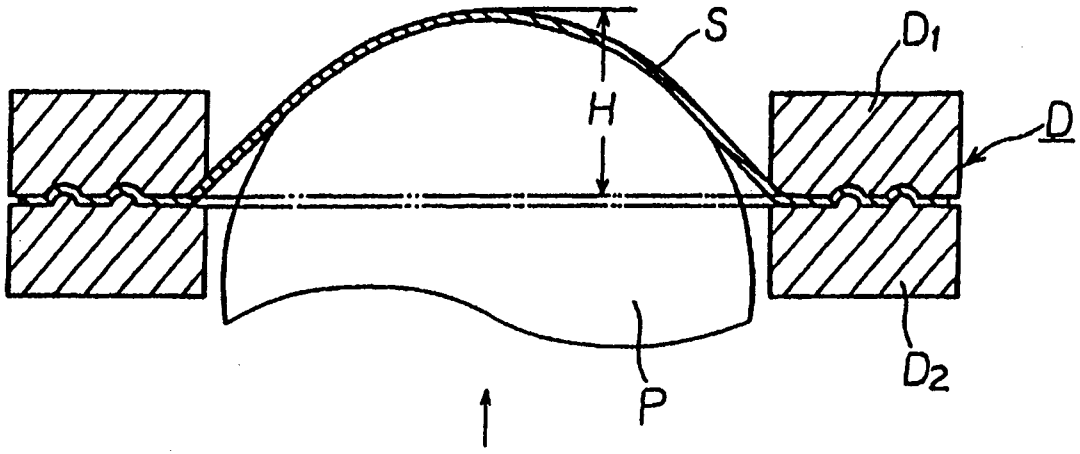
D
D1
D2
S
H
P

ALUMINUM ALLOY MATERIAL HAVING HIGH STRENGTH AND EXCELLENT FORMABILITY

BACKGROUND OF THE INVENTION

1. Field of the Invention

This invention relates to aluminum alloy sheet materials having not only high strength but also excellent formability.

2. Prior Art

Conventionally, various aluminum alloy sheet materials have been proposed for use as automobile body panels, which include, for example, an aluminum alloy sheet material containing 3.5 to 5% by weight Mg as proposed by Japanese Provisional Patent Publication (Kokai) No. 3-111532, and an aluminum alloy sheet material AA-X5085 containing 5.8 to 6.8% by weight Mg.

With the recent diversification of automobile body configuration, it is required that aluminum alloy sheet materials for use as automobile panels have not only high strength but also excellent formability. However, conventional aluminum alloy sheet materials having high strength are poor in formability, whereas ones having excellent formability are unsatisfactory in strength.

SUMMARY OF THE INVENTION

It is therefore the object of the invention to provide an aluminum alloy sheet material which has not only high strength but also excellent formability.

To attain the above object, the present invention provides an aluminum alloy sheet material consisting essentially, by weight percent (hereinafter referred to as %), of 4.5 to 6% Mg, 0.0005 to 1% rare earth elements, 0.001 to 0.15% Ti, 0.0001 to 0.004% B, 0.05 to 0.2% Fe, 0.05 to 0.1% Si, 0.0001 to 0.03% Be, and the balance of Al and inevitable impurities.

Preferably, the aluminum alloy sheet material according to the invention may further contain 0.05 to 0.3% Cu, if required.

Also preferably, the aluminum alloy sheet material according to the invention may further contain 0.1 to 1% Zn and/or 0.05 to 0.2% Mn.

Further preferably, the aluminum alloy sheet material according to the invention may further contain 0.05 to 0.3% Cu, and 0.1 to 1% Zn and/or 0.05 to 0.2% Mn.

The above and other objects, features, and advantages of the invention will be more apparent from the following detailed description.

BRIEF DESCRIPTION OF THE DRAWING

The single figure is a schematic vertical sectional view showing a manner of conducting a punch stretchability test.

DETAILED DESCRIPTION

Under the aforestated circumstances, the present inventors have made studies in order to obtain an aluminum alloy sheet material having high strength as well as excellent formability, and have reached the following finding:

An aluminum alloy sheet material consisting essentially of 4.5 to 6% Mg, 0.0005 to 1% rare earth elements, 0.001 to 0.15% Ti, 0.0001 to 0.004% B, 0.05 to 0.2% Fe, 0.05 to 0.1% Si, 0.0001 to 0.03% Be, and the balance of Al and inevitable impurities, and if required, further containing at least one element selected from the group consisting of 0.05 to 0.3% Cu, 0.1 to 1% Zn, and 0.05 to 0,2% Mn, has strength as high as that of a conventional high-strength aluminum alloy sheet material as well as much more excellent formability than that of the latter.

The present invention is based upon the above finding.

The aluminum alloy sheet material according to the invention has the aforestated chemical composition. The contents of the component elements of the aluminum alloy sheet material according to the invention have been limited as previously stated, for the following reasons:

(a) Mg (Magnesium)

Mg acts to improve the strength of the sheet. However, if the Mg content is less than 4.5%, desired high strength cannot be ensured. On the other hand, if the Mg content exceeds 6%, hot roll cracking is likely to occur. Therefore, the Mg content has been limited within the range of 4.5 to 6%.

(b) Rare Earth Elements

Rare earth elements act to further improve the formability. However, if the content thereof is less than 0.0005%, desired formability cannot be obtained on the other hand, if the content thereof exceeds 1%, the formability of the aluminum alloy sheet material is likely to be degraded. Therefore, the content of the rare earth elements has been limited within the range of 0.0005 to 1%, and preferably within a range of 0.01 to 0.2%.

(c) Ti (Titanium) and B (Boron)

Ti and B cooperatively act to make finer crystal grains of an aluminum alloy ingot in which they are contained, as well as to suppress occurrence of cracks in the ingot. Further, Ti alone acts to improve the strength, elongation and hot rollability of the ingot. However, if the contents of Ti and B are less than 0.001% and 0.0001%, respectively, the above-mentioned actions cannot be performed to a desired extent. On the other hand, if the contents of Ti and B exceed 0.15% and 0.004%, respectively, the formability of the sheet is rather degraded. Therefore, the contents of Ti and B have been limited within the ranges of 0.001 to 0.15% and 0.0001 to 0.004%, respectively. Preferably, the contents of Ti and B should be limited within ranges of 0.005 to 0.07% and 0.0005 to 0.002%, respectively.

In alloying Ti and B, preferably, only part of desired contents thereof is added to an alloying material in a melting furnace or a holding furnace to prepare a molten alloy, and the balance of Ti and B is charged into a molten alloy conduit which connects the melting furnace or the holding furnace to a casting device, i.e. an Al-Ti-B mother alloy containing the balance of Ti and B is added to the molten alloy flowing in the molten alloy conduit just prior to casting, so that the crystal grains of the ingot are made fine and the castability thereof is improved.

(d) Fe (Iron) and Si (Silicon)

Fe and Si cooperatively act to improve the hot rollability, and therefore, if either of the content of Fe and Si is less than 0.05%, an improvement in the hot rollability cannot be attained to a desired extent. On the other hand, if the contents of Fe and Si exceed 0.2% and 0.1%, respectively, the formability of the sheet is degraded. Therefore, the contents of Fe and Si have been limited within the ranges of 0.05 to 0.2% and 0.05 to 0.1%, respectively, and preferably, the Fe content should be limited within a range of 0.05 to 0.1%.

(e) Be (Beryllium)

Be acts to improve the flowability of the molten alloy as well as to increase the castability of the alloy ingot. However, if the Be content is less than 0.0001, an improvement in the flowability cannot be attained to a desired extent, whereas if the Be content exceeds 0.03%, the above action is saturated and a further improvement cannot be expected. Therefore, the Be content has been limited within the range of 0.0001 to 0.03%, and preferably within a range of 0.0003 to 0.003%.

(f) Zn (Zinc) and Mn (Manganese)

These component elements act to improve the strength of the sheet, and therefore, they may be added to the alloy when a further improvement in the strength is required. However, when the contents of Zn and Mn are less than 0.1% and 0.05%, respectively, desired improvement in the strength cannot be obtained, whereas if the contents thereof exceed 1% and 0.2%, respectively, the formability of the sheet is degraded. Therefore, the contents of Zn and Mn have been limited within the ranges of 0.1 to 1% and 0.05 to 0.2%, respectively. Preferably, the contents of Zn and Mn should be limited within ranges of 0.4 to 0.6% and 0.05 to 0.1%, respectively.

(g) Cu (Copper)

Cu acts in cooperation with rare earth elements and Ti to improve the formability, and therefore, it may be added if required. However, if the Cu content is less than 0.05%, an improvement in the formability cannot be attained to a desired extent, whereas if the content thereof exceeds 0.3%, the formability of the sheet is rather likely to be degraded. Therefore, the Cu content has been limited within the range of 0.05 to 0.3%, and preferably within a range of 0.2 to 0.3%.

In manufacturing an aluminum alloy sheet material according to the invention, it is preferable that the aluminum alloy ingot should be subjected to a two-stage homogenization treatment. More specifically, the alloy ingot should be held at a temperature of 430° to 460° C. for a predetermined time period, followed by holding the same at a temperature elevated to 490° to 510° C. for a predetermined time period. Following the homogenization treatment, the alloy ingot is hot rolled at a starting temperature of 450° to 500° C. Intermediate annealing is carried out at a temperature of 200° to 350° C. immediately after the hot rolling, followed by cold rolling. Alternatively, intermediate annealing may be carried out at a temperature of 200° to 350° C. during cold rolling following the hot rolling. The resulting cold-rolled sheet is further subjected to annealing by the use of a continuous annealing furnace in which the sheet is heated, e.g. at a temperature of 500° to 550° C. for 5 to 40 sec. In order to prevent the occurrence of stretcher strain marks during formation of sheets, it is necessary to enlarge the crystal grain size. Therefore, it is preferable that the annealing should be carried out at a high temperature and for a long time period. Further preferably, the annealing temperature should be set to a high temperature value and the alloy sheet is rapidly quenched after the high temperature annealing is finished.

Example

Examples of the aluminum alloy sheet material of the invention will be explained hereinbelow:

Aluminum alloys having chemical compositions shown in Tables 1 and 2 were prepared by melting the component elements in a crucible furnace and then an Al-Ti-B mother alloy was added into a molten alloy conduit connecting the crucible furnace to a casting device. The thus prepared alloys were cast by an ordinary semicontinuous casting method to form alloy ingots each having a size of 44 mm×200 mm in cross section and 500 mm in length. The ingots were each heated and held at a temperature within a range of 430° to 460° C. for 16 hours, and then subjected to homogenization treatment at a temperature within a range of 490° to 510° C. for 16 hours. The resulting homogenized ingots had surfaces thereof scalped, followed by carrying out hot rolling by heating the scalped ingots at a temperature within a range of 450° to 500° C., to thereby prepare hot-rolled plates each having a thickness of 8 mm. The thus prepared plates were further subjected to intermediate annealing at a temperature within a range of 200° to 350° C. for 4 hours, followed by cold rolling, to thereby obtain aluminum alloy sheet materials each having a thickness of 1 mm. Then, the sheets were subjected to final annealing such that they were quickly heated to a predetermined temperature within a range of 500° to 550° C., held at the same temperature for 10 sec, and then quenched, thereby producing aluminum alloy sheet material test pieces Nos. 1 to 24.

TABLE 1

| TEST PIECES | Mg | RARE EARTH ELEMENTS Ce | La | Y | Ti | B | Fe | Si | Be | Zn | Mn | Cu |
|---|---|---|---|---|---|---|---|---|---|---|---|---|
| ALUMINUM ALLOY SHEET MATERIALS OF PRESENT INVENTION | | | | | | | | | | | | |
| 1 | 4.53 | 0.062 | 0.037 | — | 0.05 | 0.0031 | 0.12 | 0.06 | 0.0008 | — | — | — |
| 2 | 5.46 | 0.00054 | — | — | 0.04 | 0.0031 | 0.11 | 0.07 | 0.0003 | — | — | — |
| 3 | 5.25 | 0.0018 | 0.00093 | — | 0.05 | 0.0031 | 0.12 | 0.06 | 0.0008 | — | — | — |
| 4 | 5.32 | — | — | 0.019 | 0.05 | 0.0031 | 0.13 | 0.09 | 0.0003 | — | — | — |
| 5 | 5.35 | 0.12 | 0.063 | — | 0.05 | 0.0003 | 0.11 | 0.08 | 0.0008 | — | — | — |
| 6 | 5.95 | — | 0.32 | — | 0.05 | 0.0003 | 0.11 | 0.07 | 0.0003 | — | — | — |
| 7 | 5.36 | 0.36 | 0.18 | — | 0.04 | 0.0003 | 0.11 | 0.07 | 0.0008 | — | — | — |
| 8 | 5.46 | 0.054 | 0.032 | — | 0.001 | 0.0002 | 0.11 | 0.07 | 0.0003 | — | — | — |
| 9 | 5.42 | 0.058 | 0.035 | — | 0.008 | 0.0010 | 0.11 | 0.08 | 0.0003 | — | — | — |
| 10 | 5.39 | 0.057 | 0.031 | — | 0.02 | 0.0011 | 0.10 | 0.07 | 0.0003 | — | — | — |
| 11 | 5.25 | 0.058 | 0.034 | — | 0.13 | 0.0003 | 0.10 | 0.06 | 0.0008 | — | — | — |
| 12 | 5.36 | 0.056 | 0.031 | — | 0.05 | 0.0012 | 0.11 | 0.07 | 0.0003 | — | — | — |
| 13 | 5.37 | 0.057 | 0.032 | — | 0.05 | 0.0012 | 0.06 | 0.05 | 0.0003 | — | — | — |

TABLE 2

| TEST PIECES | Mg | RARE EARTH ELEMENTS Ce | La | Y | Ti | B | Fe | Si | Be | Zn | Mn | Cu |
|---|---|---|---|---|---|---|---|---|---|---|---|---|
| ALUMINUM ALLOY SHEET MATERIALS OF PRESENT INVENTION | | | | | | | | | | | | |
| 14 | 5.36 | 0.058 | 0.033 | — | 0.05 | 0.0011 | 0.16 | 0.08 | 0.0032 | — | — | — |
| 15 | 5.32 | 0.057 | 0.031 | — | 0.05 | 0.0012 | 0.08 | 0.06 | 0.028 | — | — | — |
| 16 | 5.42 | 0.032 | 0.017 | — | 0.06 | 0.0011 | 0.09 | 0.06 | 0.0003 | 0.64 | — | — |
| 17 | 5.31 | 0.033 | 0.017 | — | 0.06 | 0.0011 | 0.09 | 0.06 | 0.0032 | — | 0.12 | — |
| 18 | 5.46 | 0.032 | 0.016 | — | 0.06 | 0.0011 | 0.10 | 0.07 | 0.0034 | — | — | 0.05 |
| 19 | 5.43 | 0.032 | 0.016 | — | 0.05 | 0.0011 | 0.09 | 0.06 | 0.0032 | — | — | 0.23 |
| 20 | 5.40 | 0.033 | 0.017 | — | 0.05 | 0.0012 | 0.08 | 0.06 | 0.0003 | 0.12 | — | 0.21 |
| 21 | 5.34 | 0.032 | 0.017 | — | 0.09 | 0.0011 | 0.08 | 0.06 | 0.0003 | 0.45 | — | 0.23 |
| 22 | 5.32 | 0.033 | 0.017 | — | 0.06 | 0.0011 | 0.08 | 0.07 | 0.0008 | — | 0.07 | 0.06 |
| 23 | 5.35 | 0.032 | 0.016 | — | 0.05 | 0.0012 | 0.08 | 0.06 | 0.0003 | 0.46 | 0.08 | — |
| 24 | 5.38 | 0.033 | 0.016 | — | 0.05 | 0.0012 | 0.08 | 0.06 | 0.0003 | 0.46 | 0.07 | 0.22 |

Next, the thus produced aluminum alloy sheet material test pieces Nos. 1 to 24 according to the present invention were subjected to a tensile test and a punch stretchability test. The tensile test was conducted in order to measure the tensile strength, yield strength, and elongation of each of the alloy sheets, and the punch stretchability test in order to measure limiting rupture height thereof, respectively. The strength of the aluminum alloy sheet materials was evaluated based on the tensile strength and yield strength, and the formability thereof was evaluated based on the elongation and limiting rupture height. The results of the measurements are shown in Table 3.

TABLE 3

| TEST PIECES | TENSILE STRENGTH | YIELD STRENGTH | ELONGATION (%) | LIMITING RUPTURE HEIGHT (mm) |
|---|---|---|---|---|
| ALUMINUM ALLOY SHEET MATERIALS OF PRESENT INVENTION | | | | |
| 1 | 25.8 | 10.2 | 33.2 | 37.0 |
| 2 | 26.8 | 10.7 | 36.0 | 37.5 |
| 3 | 26.7 | 10.6 | 36.5 | 37.5 |
| 4 | 27.1 | 11.0 | 37.2 | 37.5 |
| 5 | 27.8 | 11.7 | 37.3 | 38.0 |
| 6 | 27.5 | 11.2 | 36.7 | 37.5 |
| 7 | 27.8 | 11.6 | 36.5 | 37.5 |
| 8 | 27.6 | 11.5 | 37.5 | 37.5 |
| 9 | 27.7 | 11.5 | 37.3 | 37.5 |
| 10 | 27.7 | 11.5 | 37.8 | 38.0 |
| 12 | 27.5 | 11.4 | 37.5 | 37.5 |
| 13 | 27.3 | 11.3 | 37.8 | 38.0 |
| 14 | 27.5 | 11.2 | 37.3 | 37.0 |
| 15 | 27.3 | 11.2 | 37.9 | 37.0 |
| 16 | 27.8 | 11.7 | 37.5 | 37.5 |
| 17 | 27.7 | 11.7 | 37.1 | 38.0 |
| 18 | 27.7 | 11.5 | 38.0 | 37.5 |
| 19 | 28.4 | 11.7 | 37.9 | 38.5 |
| 20 | 28.3 | 11.6 | 37.8 | 38.0 |
| 21 | 28.9 | 12.3 | 37.8 | 38.0 |
| 22 | 27.8 | 11.7 | 38.3 | 38.0 |
| 23 | 27.6 | 11.6 | 37.2 | 37.5 |
| 24 | 28.8 | 12.2 | 37.5 | 38.0 |

The punch stretchability test was conducted in a manner as shown in the figure.

First, a test piece S having a size of 180 mm in diameter and 1 mm in thickness was sandwiched by a die D formed of upper and lower annular die halves $D_1$ and $D_2$ each having a size of 104 mm in inner diameter and 180 mm in outer diameter under a condition that the pressing load by the die is set to 5 tons. Beef tallow was used as a lubricant. The test piece S was upwardly bulged by extruding a ball head punch P having a diameter of 100 mm, and level of the top of the bulged test piece S assumed when a rupture has occurred in the test piece was defined as the limiting rupture height H.

When a tensile test and a punch stretchability test are conducted on the conventional high-strength aluminum alloy sheet material in the same manner as mentioned above, the test results show in general the following properties:

Tensile strength: 25 to 30 kgf/mm$^2$,
Yield strength: 10 to 12 kgf/mm$^2$,
Elongation: 27 to 30%, and
Limiting rupture height: 30 to 35 mm.

By contrast, it is apparent from Tables 1 to 3 that the aluminum alloy sheet materials Nos. 1 to 24 of the present invention have not only the same degree of strength as that of the conventional high-strength aluminum alloy sheet material but also much more excellent formability than that of the latter.

As described hereinabove, the aluminum alloy sheet material of the present invention has high strength as well as excellent formability, so that it can satisfactorily cope with the recent diversification in configuration of automobile body panels and other various fabricated products as well as reduction in the wall thickness thereof.

What is claimed is:

1. An aluminum alloy sheet having high strength and excellent formability, consisting essentially, by weight percent, of 4.5 to 6% Mg, 0.01 to 0.2% rare earth elements, 0,005 to 0.07% Ti, 0.0005 to 0,002% B, 0.05 to 0.1% Fe, 0.05 to 0.1% Si, 0.0003 to 0.003% Be, 0.4 to 0.6% Zn, 0.2 to 0.3% Cu, and the balance being Al and inevitable impurities.

2. The aluminum alloy sheet of claim 1, wherein the rare earth element is selected from the group consisting of Ce, La, Y and combinations thereof.

3. An aluminum alloy sheet which consists essentially of 5.34 weight % Mg, 0.032 weight % Ce, 0.017 weight % La, 0.09 weight % Ti, 0.0011 weight % B, 0.08 weight % Fe, 0.06 weight % Si, 0.0003 weight % Be, 0.45 weight % Zn, 0.23 weight % Cu, and the balance being Al and inevitable impurities.

4. An aluminum alloy sheet having high strength and excellent formability, consisting essentially, by weight percent, of 4.5 to 6% Mg, 0.01 to 0.2% rare earth elements, 0.005 to 0.07% Ti, 0.0005 to 0.002% B, 0.05 to 0.1% Fe, 0.05 to 0.1% Si, 0.0003 to 0.003% Be, 0.2 to 0.3% Cu, 0.4 to 0.6% Zn, 0.05 to 0.1% Mn, and the balance being Al and inevitable impurities.

5. The aluminum alloy sheet of claim 4, wherein the rare earth element is selected from the group consisting of Ce, La, Y and combinations thereof.

6. The aluminum alloy sheet of claim 5, which consists essentially of 5.38 weight % Mg, 0.033 weight % Ce, 0,016 weight % La, 0.05 weight % Ti, 0.0012 weight % B, 0.08 weight % Fe, 0.06 weight % Si, 0.0003 weight % Be, 0.46 weight % Zn, 0.07 weight % Mn, 0.22 weight % Cu and the balance being Al and inevitable impurities.

* * * * *